US007721656B2

(12) United States Patent
Indio da Costa

(10) Patent No.: US 7,721,656 B2
(45) Date of Patent: May 25, 2010

(54) MONORAIL VEHICLE

(76) Inventor: Luiz Augusto de Siqueira Indio da Costa, Rua Pinheiro Guimarães, 101, Botafogo, 22281-080, Rio de Janeiro (BR)

( * ) Notice: Subject to any disclaimer, the term of this patent is extended or adjusted under 35 U.S.C. 154(b) by 0 days.

(21) Appl. No.: 11/632,627

(22) PCT Filed: Jul. 18, 2005

(86) PCT No.: PCT/BR2005/000130

§ 371 (c)(1),
(2), (4) Date: Jan. 15, 2007

(87) PCT Pub. No.: WO2006/007679

PCT Pub. Date: Jan. 26, 2006

(65) Prior Publication Data

US 2007/0256588 A1 Nov. 8, 2007

(30) Foreign Application Priority Data

Jul. 16, 2004 (BR) ..... 0402777

(51) Int. Cl.
*B61K 1/00* (2006.01)

(52) U.S. Cl. ..... 104/124; 104/28; 104/139; 105/199.1

(58) Field of Classification Search ..... 105/199.1, 105/199.2, 141; 104/139, 118, 124, 125, 104/27, 28, 29
See application file for complete search history.

(56) References Cited

U.S. PATENT DOCUMENTS 3,791,308 A * 2/1974 Hartz ..... 104/139
3,838,648 A 10/1974 Dahlberg et al.
3,859,925 A 1/1975 Hartz
4,690,064 A 9/1987 Owen
4,996,928 A 3/1991 Janssen et al.
5,027,712 A 7/1991 Wallick
5,074,220 A 12/1991 Petersen
5,456,183 A 10/1995 Geldbaugh
5,845,581 A 12/1998 Svensson
6,012,396 A 1/2000 Schulz
6,182,576 B1 2/2001 Svensson
6,273,003 B1 * 8/2001 Benker et al. ..... 105/199.2

(Continued)

FOREIGN PATENT DOCUMENTS

DE 202 09 077 1/2003

(Continued)

OTHER PUBLICATIONS

International Search Report for International Application No. PCT/BR2005/000130.

(Continued)

*Primary Examiner*—Mark T Le
(74) *Attorney, Agent, or Firm*—Fay Sharpe LLP

(57) ABSTRACT

A monorail vehicle includes a cabin for housing a driver, passengers and/or load and also includes one or more driving assemblies, the driving assemblies being suitable for running within a guiding duct on the ground, the cabin being connected to at least one driving assembly by an elongated elevation structure. The elongated elevation structure is actuated in order to vary the elevation of the cabin with respect to the ground during regular travel of the vehicle.

11 Claims, 11 Drawing Sheets

U.S. PATENT DOCUMENTS

| | | | | |
|---|---|---|---|---|
| 6,688,235 | B2 | 2/2004 | Rajaram | |
| 6,763,766 | B1 * | 7/2004 | Cornellier | 104/20 |
| 6,857,493 | B2 * | 2/2005 | Shupp et al. | 180/168 |

FOREIGN PATENT DOCUMENTS

| | | |
|---|---|---|
| DE | 202 08 510 | 2/2003 |
| FR | 2 658 475 | 2/1990 |
| GB | 1 367 119 | 9/1974 |
| GB | 1 529 060 | 10/1978 |
| GB | 2 305 645 | 4/1997 |
| RU | 2 146 627 | 3/2000 |
| WO | WO02/053454 | 7/2002 |

OTHER PUBLICATIONS

International Preliminary Report on Patentability for International Application No. PCT/BR2005/000130.

* cited by examiner

MONORAIL VEHICLE

The present invention relates to a monorail vehicle comprising a cabin for housing a driver, passengers and/or load and one or more driving assemblies, the driving assemblies being suitable for running within a guiding duct on the ground, the cabin being connect to at least one driving assembly by means of an elongated elevation structure.

DESCRIPTION OF THE PRIOR ART

As a solution for mass transportation, an alternative that is already widely known for its relative simplicity lies in the use of monorail systems, in which a vehicle similar to a train moves on a single rail.

Basically three types of monorail vehicles are known: suspended under a rail, suspended laterally to a rail or moving over a rail. The expression "rail" is employed herein to designate any stationary elongated structure that provides a guiding element for displacement of the vehicle.

The type of monorail that is suspended under a rail is described, for instance, in U.S. Pat. No. 5,074,220, U.S. Pat. No. 5,027,712 and U.S. Pat. No. 6,688,235. In this system, the vehicle moves under a rail structure, where the wagon is coupled to the rail by means of coupling structures, wherein the lower end of these coupling structures is attached to the vehicle cabin and, at the upper end, there are rolling and driving devices for displacement of the vehicle along the rail. In this system, it is necessary to build an elevated structure for supporting the rail, at a height that at least exceeds the height of the vehicle itself.

The type of monorail suspended laterally to the rail structure is illustrated, for instance, in U.S. Pat. No. 4,690,064. In this case, the vehicle comprises a side structure for coupling to the rail, which includes a support arm connected to a driving assembly. The wheels of the driving assembly move inside a lateral rail structure. The rail structure consists of a T-shaped masonry structure, which is elevated with respect to the ground.

The type of monorail that moves on rails is described, for instance, in U.S. Pat. No. 4,996,928, U.S. Pat. No. 5,845,581 and U.S. Pat. No. 6,182,576 and in Russian patent RU 2,146,627. In these models, the rail extends under the vehicle center, on which the vehicle moves by means of wheels.

A variation of the latter type described in disclosed in patent GB 1,529,060 and especially in U.S. Pat. No. 3,838,648, in which the driving wheels of the monorail vehicle are completely embedded inside the rail. In the first case, the wheels are housed inside a U-shaped duct that is open upwards, whereas in the second case a similar duct is closed at the upper part, except for a narrow slot through which a connection element passes for connection between the vehicle body and the driving assembly that is embedded inside the duct.

Another particular variation of the monorail vehicle is illustrated in U.S. Pat. Nos. 5,456,183 and 6,012,396. According to this variation, there is a utilization of the space on public ways at a height sufficient for allowing at least passenger cars to circulate directly under the monorail vehicle or at least close to it, thus minimizing the loss of space on the roadway and providing a minimally elevated structure.

In a number of the mentioned models, in addition to vertical wheels for displacing and driving the vehicle, transverse and inclined auxiliary wheels are also foreseen to provide greater balance of the vehicle and prevent it from uncoupling from the rails.

Yet a particularly suitable system for metropolitan spaces with little room for additional transportation vehicles is disclosed in patent GB 1,367,119. This patent reveals a transportation system in which the cabin of the monorail is permanently elevated by vertical struts. While this known system allows regular vehicles to travel underneath the monorail cabin, occupying only a minor space at ground level, it also avoids fixed elevated masonry structures which require higher costs for construction, and which have a visual impact on the surroundings.

Innumerable other transportation systems still provide for means for varying the elevation of the cabin. For instance, patent application UK2,305,645 provides for a type of monorail system which travels underneath a fixed elevated structure of a type already described, but which can be lowered to the level of the ground for embarking and disembarking passengers. This system also provides that the cabin can start to descend shortly before a full stop in order to reduce or eliminate non-vertical acceleration on passengers.

Several other non-monorail systems also provide for the variation of elevation of a cabin, such as the vehicles depicted in WO 02/53454, and German utility models DE 202 09 077 U1 and DE 202 08 510 U1.

In every such systems with variable elevation, the cabin is in a certain high during normal transportation and is lowered or elevated only for embarking and disembarking passengers.

DRAWBACKS OF THE PRIOR ART

Despite the advantages presented by each of the types of monorail described, the solution provided for traffic problems, in particular in the big cities, still require relatively complex works in the case of overhead ways, be it in cases where the vehicle runs suspended under the rail or suspended over the rail, but at an elevated structure.

In the cases where conventional models with the rail at ground level are employed, the vehicle occupies a traffic lane, which may entail deterioration of the conditions of flow of other vehicles, aggravating the problem of saturation of traffic in big cities.

A system in which the monorail vehicle is provided with struts presents the disadvantage that possibly not all of the transportation route is free of obstacles for the elevated vehicle to pass. Moreover, an elevated vehicle poses concerns as to its stability at higher speeds.

BRIEF DESCRIPTION OF THE INVENTION

The present invention has the objective of providing a transportation system, especially for large cities, based on the concept of monorail, but that prevents the need for complex civil-engineering works to build suspended ways and that, simultaneously, prevents the occupation of a traffic lane for traffic of the monorail vehicle.

This objective is achieved, according to the present invention, by means of a monorail vehicle that runs over a rail on the ground, especially in the form of a duct. The invention is characterized in that the elongated elevation structure can be actuated in order to vary the elevation of the cabin with respect to the ground during regular travel of the vehicle.

Therefore, differently from the system of GB 1,367,119 the cabin can travel at different elevations, and differently from known vehicles with variable elevation capacity, the cabin is not intended to be lowered or elevated only for embarking and disembarking passengers, which solution results in particular advantages as it will be explained in further details on the basis of preferred embodiments illustrated in the drawings.

BRIEF DESCRIPTION OF THE DRAWINGS

The present invention will now be described in greater detail with reference on an embodiment represented in the drawings. The figures show.

DETAILED DESCRIPTION OF THE FIGURES

Figure 1:
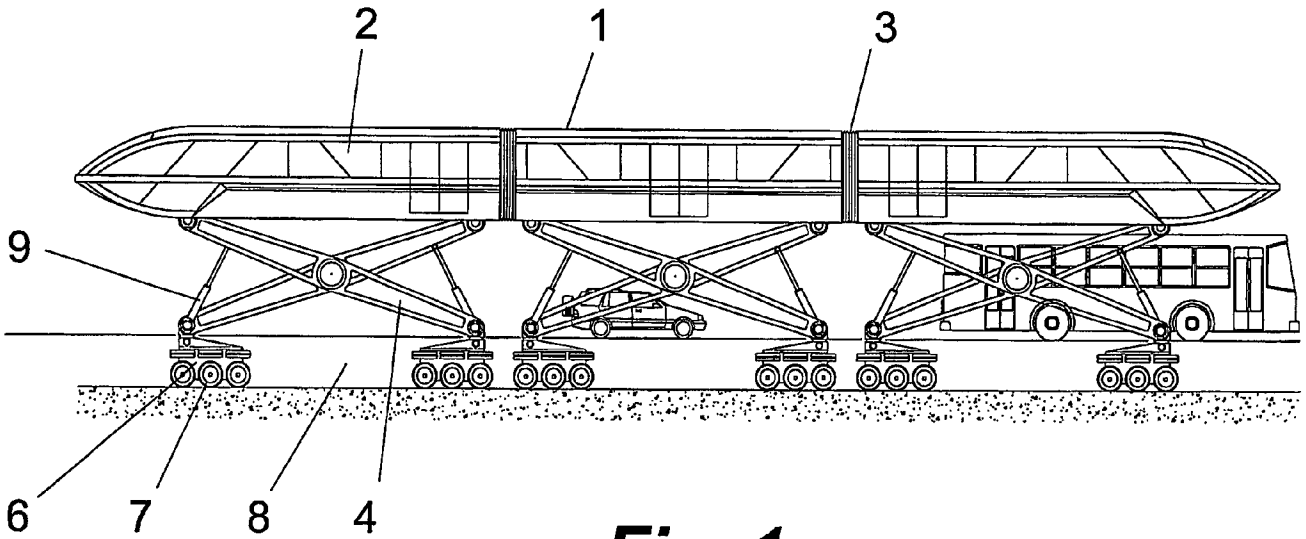
FIGS. 1 and 2 are a schematic side and front views of the monorail vehicle of the present invention in its maximum elevation, seen in proportion with conventional passenger cars.
Figure 2:
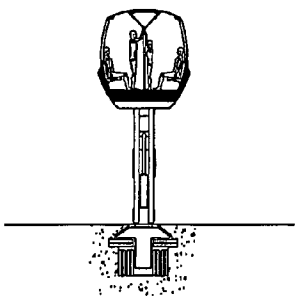

As shown in particular in FIG. 1, the vehicle 1 of the present invention basically comprises a cabin 2 and a number of driving assemblies 6, 7 traveling inside a guiding duct 8. The cabin may be subdivided into two, three or more articulated sections and with a concertinaed fitting part 3 linking two adjacent sections of the cabin. Each driving assembly comprises at least one pair of wheels 7, preferably two or more pairs, and at least one of the assemblies is equipped with a motor 6, preferably an electric motor, for driving the wheels 7.

As can be seen in FIGS. 1 to 6, the characteristic element of vehicle 1 of the present invention lies in that the vehicle cabin 2 can regularly travel at different elevations. Preferably, at maximum elevation (FIGS. 1 and 2) the cabin lies at approximately 3.5 meters from ground level. In middle elevation (FIGS. 3 and 4), the cabin lies preferably at approximately 2.8 meters from the ground level.

Figure 3:
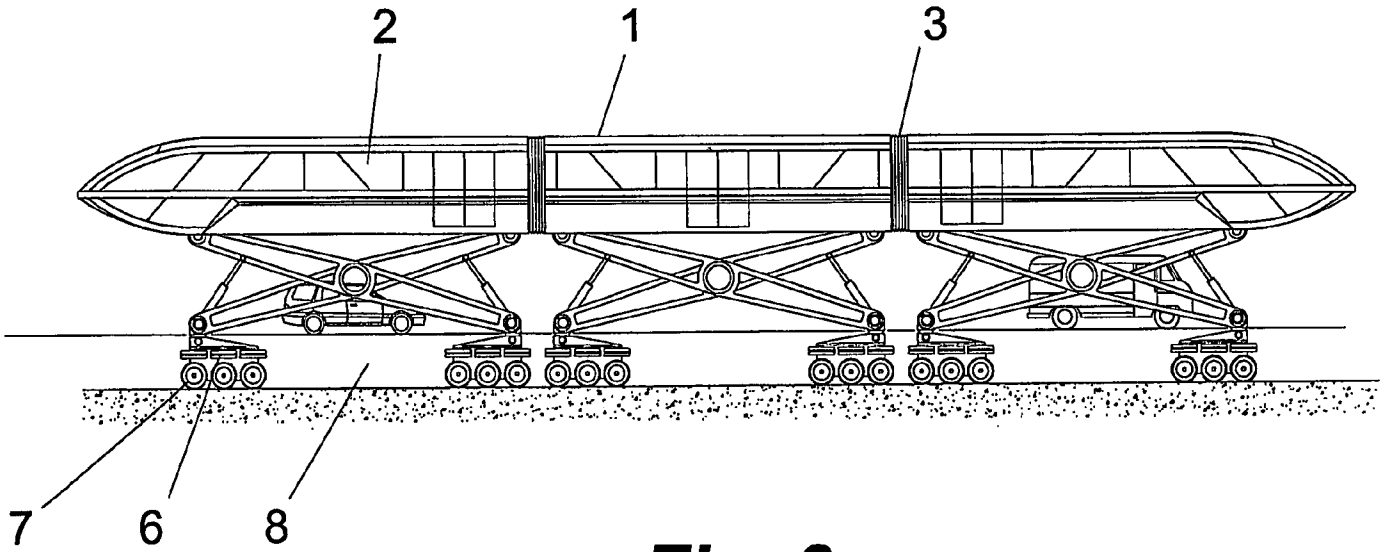
FIGS. 3 and 4 are a schematic views of the monorail vehicle at middle elevation.
Figure 4:
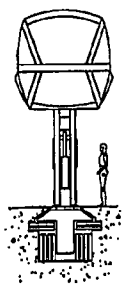

As can be seen in FIGS. 1 and 3, the raised elevation of vehicle cabin 2 of monorail vehicle 1 is a level that creates a clear vertical space, between the vehicle cabin 2 and driving assemblies 6,7, to allow the bottom of the cabin 2 and the top of a driving assembly 6,7 to respectively stay clear of the top and bottom of a vehicle adjacent to the monorail vehicle 1.

Figure 5:
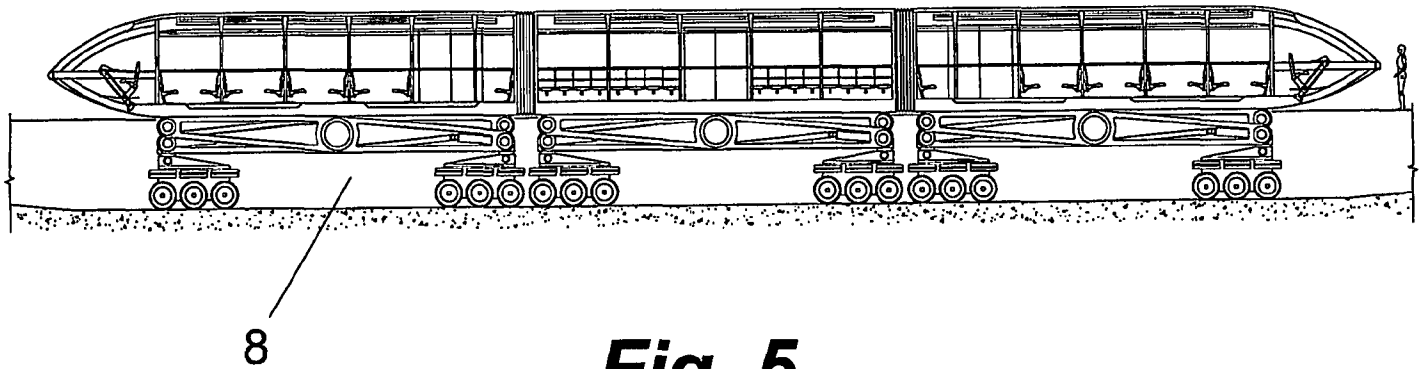
FIGS. 5 and 6 are lateral schematic views of the monorail vehicle at minimum elevation.
Figure 6:
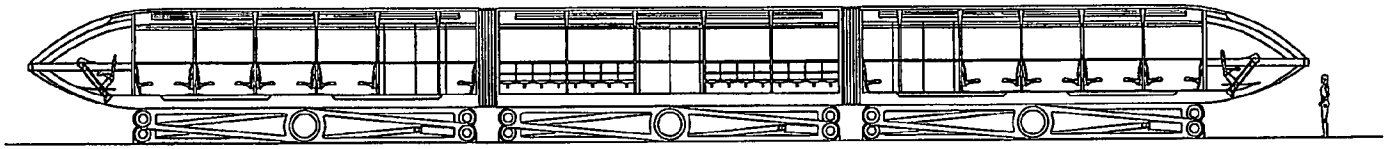

At minimum elevation there are basically two alternatives: if the guiding duct 8 is more profoundly built into the ground as depicted in FIG. 5, the cabin lies approximately at ground level. Otherwise, as depicted in FIG. 6, the cabin lies approximately 1 meter above ground level and requires an embarking platform at about the same high.

A minimum elevation can be used either for embarking/disembarking but is also suitable to areas in which the cabin is not required to travel above regular traffic and thus can travel close to the ground enhancing its stability and allowing the vehicle to travel at higher speeds. The lowered position is also suitable to be used in tunnels and viaducts as also depicted in the drawings.

The variable elevation of the cabin is achieved by means of scissors 4, or any similar articulated structure, in which its two sections are pivoted in the center, at the base of the cabin and at the driving assemblies. The scissors 4 can be actuated in order to vary the elevation of the cabin by means of hydraulic or pneumatic pistons 9 in a traditional manner. In order to provide the necessary stability to the monorail vehicle to travel in any possible elevation, scissors 4 preferably have double structure as depicted for instance in FIGS. 8 to 10. It is also obvious for the person skilled in the art that the pistons 9 or any other device for varying the elevation must be appropriately designed to ensure a stable maintenance of the elevation during regular travel conditions.

Figure 7:
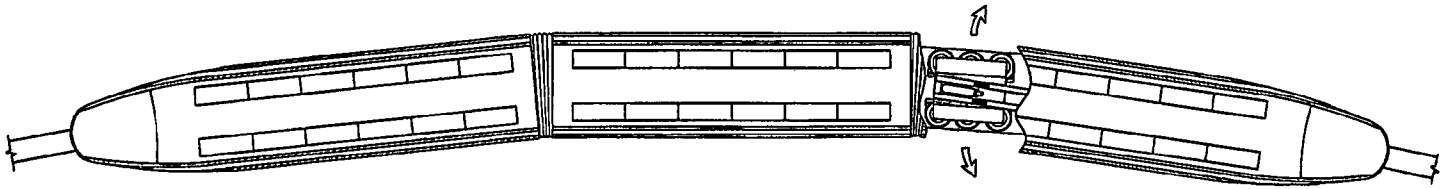
FIG. 7 is a schematic top view, partially sectioned, showing details of the articulated fixation of the boogies in the scissors.

FIG. 7 shows that the boogies of the scissors are also articulated in the horizontal plane in the driving assemblies, in order to accommodate the relative movement between the driving assemblies and the cabin when the vehicle is traveling in curves.

Figure 8:
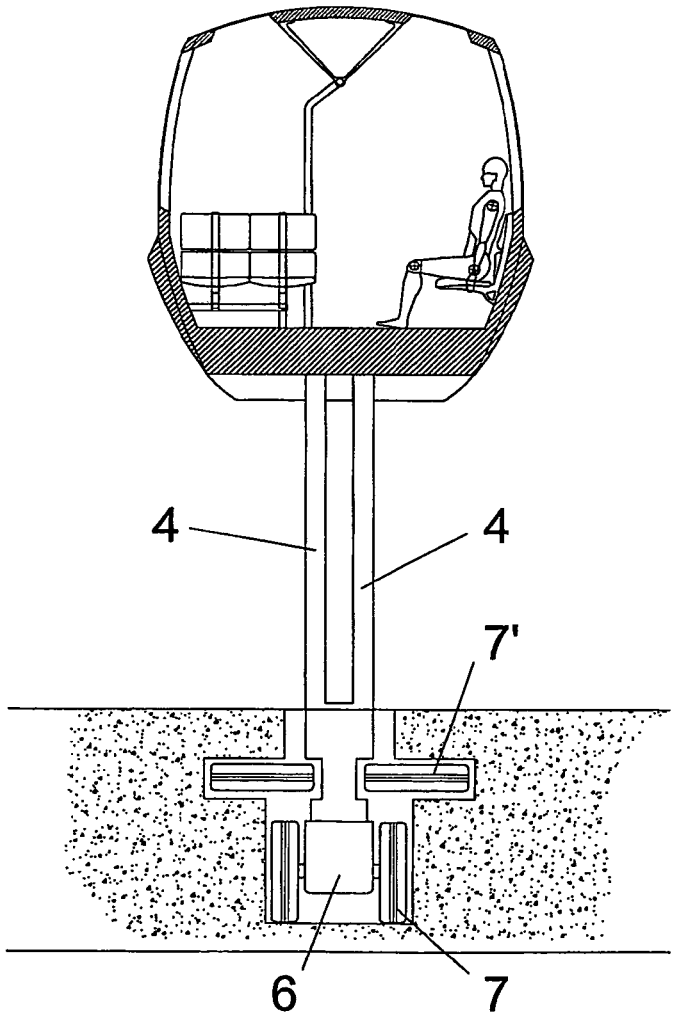
FIG. 8 is a front sectional view of an embodiment using stabilizer horizontal wheels.

FIG. 8 shows an embodiment in which horizontal stabilizer wheels 7 are provided in addition to the regular vertical wheels 7. In this case, the duct is accordingly configured with secondary side ducts to house the horizontal auxiliary wheels. The auxiliary wheels may also be inclined and rest against an internal structure in the duct, as described, for example, in U.S. Pat. No. 5,845,581.

Figure 9:
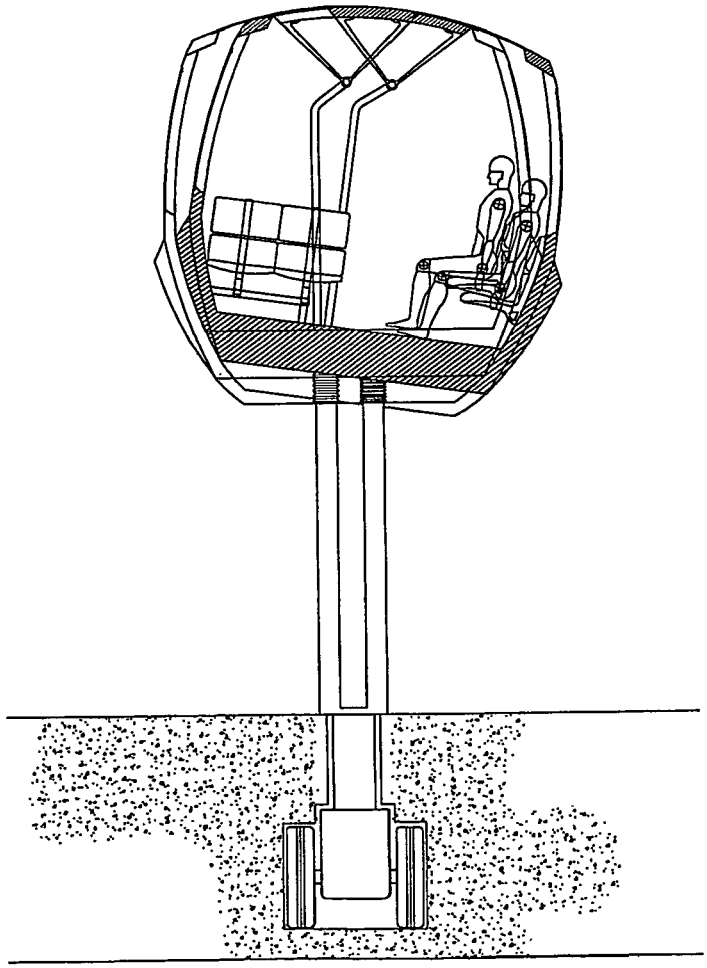
FIG. 9 is a schematic front sectional view of an embodiment comprising an active suspension.

FIG. 9 shows in an schematic way that the connection between the upper ends of the scissors and the bottom of the cabin can be equipped with an active suspension, which inclines the cabin during curves in order at least partly to compensate for lateral acceleration, according to an application already known in some types of trains. In addition, in non-illustrated embodiments, to offset possible unbalances caused by the uneven distribution of passengers and/or load in the cabin, the vehicle may be equipped with dynamic compensation devices commanded automatically, such as a counter-weight displaceable to the side or ballast tanks on both sides, between which a fluid may be pumped so as to rebalance the vehicle. Also, one may use inertia-disc-type rotary devices to aid in maintaining the stability.

Figure 10:
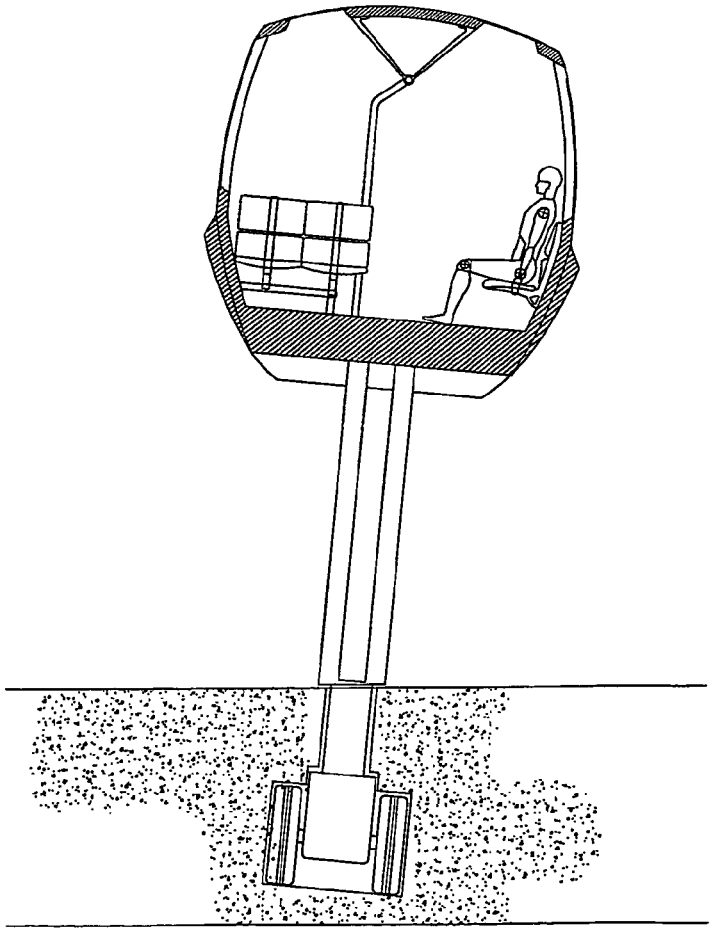
FIG. 10 is also a schematic sectional front view of an embodiment showing the duct with an inclination.

An alternative to the active suspension relies in providing the ducts with a fixed inclination in curves as depicted in FIG. 10.

Yet another alternative, not illustrated, for inclining the whole composition consists in configuring the driving assembly with vertical wheels arranged in rows and with auxiliary side wheels, the bottom of the duct being provided with a gutter inside which the vertical wheels move. The inclination, in this case, may be achieved by displacing the gutter from the center of the duct, like that illustrated in FIG. 3 of document GB 1,529,060.

Figure 11:
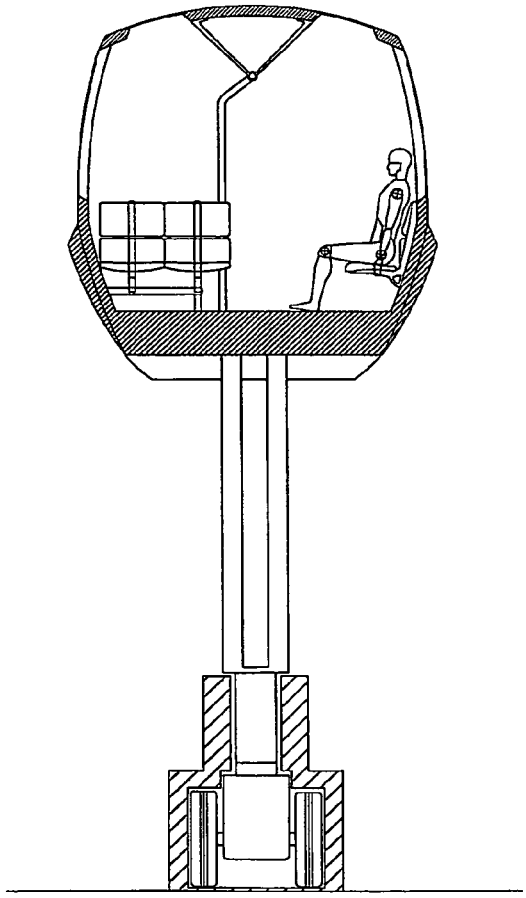
FIG. 11 is a schematic sectional front view of an embodiment in which the duct is fully constructed above floor level.

FIG. 11 shows an alternative to a fully build-in duct, in which the duct is fully constructed over the ground level. This embodiment may be suitable for stretches in which the vehicle runs over flower-beds, between guard-rails that divide roadways, bridges, or in any other area where the traffic of the monorail vehicle will take place out of public ways, dispensing with the preservation of an traffic area below the monorail vehicle. Of course, intermediary solutions can be applied, in which the duct is only partially buried in the ground, and partially exposed above it.

Figure 12:
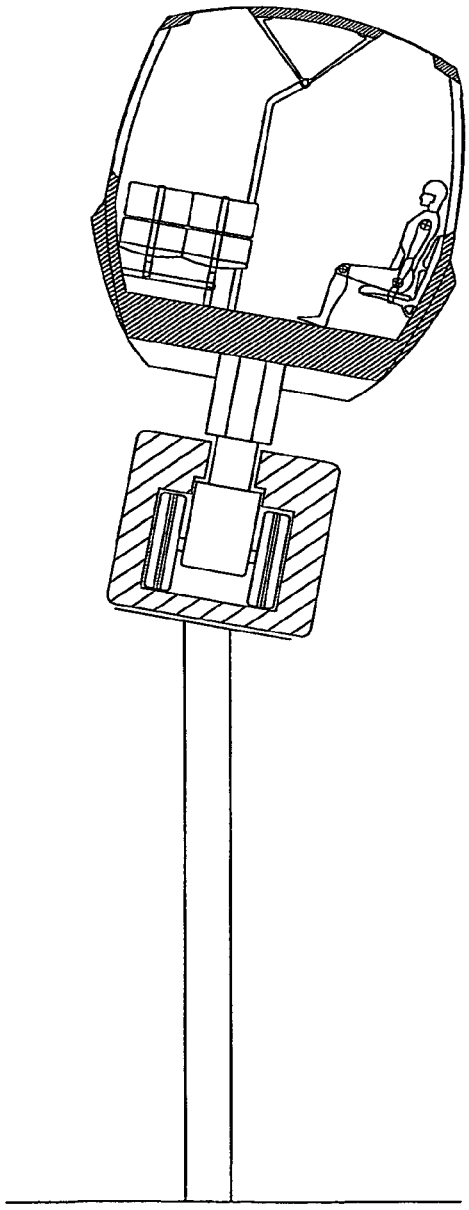
FIG. 12 is a schematic sectional front view of an embodiment in which the duct is provided on an elevated structure such as a bridge or a viaduct.

FIG. 12 shows an embodiment in which the monorail vehicle is traveling with scissors fully retracted on a duct provided in an elevated structure such as a bridge or a viaduct.

Figure 13:
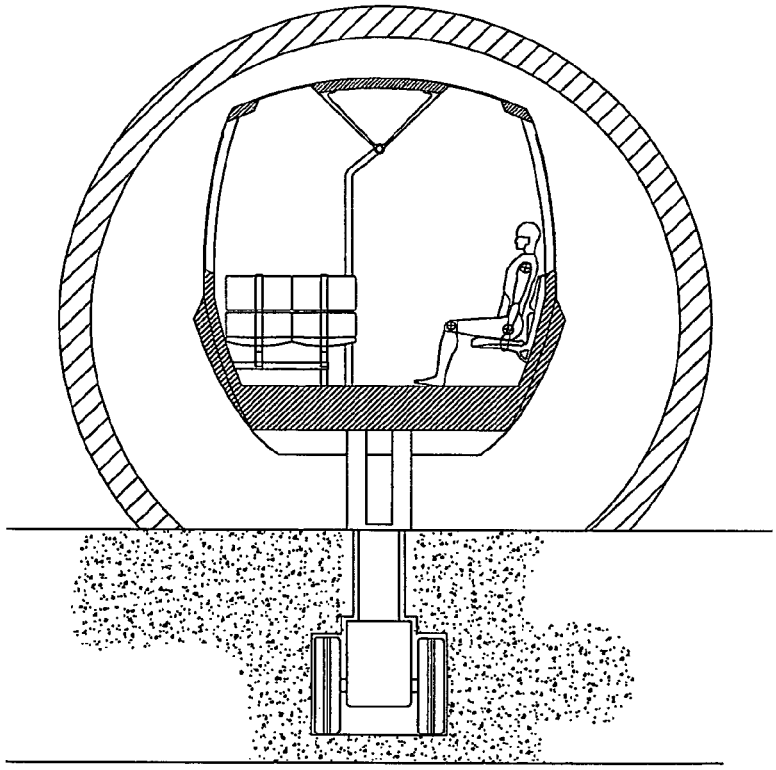
FIG. 13 illustrates a passageway for the monorail vehicle.

FIG. 13 illustrates another possible embodiment of a passageway for the monorail vehicle, in which the vehicle travels inside a tunnel which can be an existing tunnel or a tunnel built specially for passage of the monorail vehicle. In this situation, the vehicle travels at minimum elevation, therefore allowing the tunnel to be relatively low in terms of internal high. Although not illustrated, it is obvious that the monorail vehicle can also travel in tunnels having regular traffic e.g. of cars and buses, provided the adequate conditions are met.

The duct 8 is made of a masonry or partly-metallic structure and is preferably totally embedded in the ground. However, as mentioned, an upper part of the duct may project only slightly above the street level and/or comprise a sounding undulating surface to alert the driver of a vehicle that he is passing very close to the area of the monorail vehicle. Duct 8 may also consist of a pre-manufactured metallic tube with the dimensions, shape and characteristics suitable for housing the driving assembly and the respective electric conductors, as the case may be.

The driving assembly 6, 7 is formed by a motor and wheels and is totally contained inside the duct 8. Preferably, the upper part of the duct is closed, except for a slot for passage of the lower portion of the scissors or a inking element between the scissors and the respective driving assembly. As ill be described, this slot may be kept closed while the vehicle is not running long the respective stretch of the duct.

Especially as illustrated in FIGS. 8 to 13, in order to impart stability to the assembly, especially considering the lever arm formed by the vehicle elevation with respect to the ground, the inside of the duct 8 has its width dimensioned for housing a driving assembly 6, 7 with a width greater than that of the elevation scissors 4 itself. In this way, although the width occupied by the scissors 4 at the height of the vehicles passing along the street is small, the width of the driving assembly 6, 7 is large enough to ensure the necessary lateral stability of the vehicle.

The driving assembly comprises a motor 6, preferably an inductive electric motor. In this case, the respective cables and electric connections are provided inside the duct 8. The connection between the electric motor and the cables may be made in a conventional way, by means of brushes or other types of connectors, or else by induction without physical contact. Although preference is given to an electric motor, it is also possible to use any other type of motor. Finally, it is also possible to provide a propulsion outside the driving system and connected thereto by a suitable transmission.

The second driving assembly of one section of the vehicle can be equipped with a set of batteries (not illustrated) instead of a motor, in order to provide power to the electric motor in cases of failure of power supply.

The same electric current feeding system that feeds the electric motor may also be used—through cables linking the driving assembly to the cabin, passing through the elevation scissors—to feed the pieces of equipment inside the vehicle, such as control panel of the conductor, internal lights and air-conditioning equipment. However, it is also possible to install autonomous generating units in the cabin.

The duct slot, through which the elevation scissors 4 or said connecting element passes for connection between the lower portion of the scissors and the respective driving assembly, may be maintained at least partly closed by flaps that open only with the passage of the vehicle. Such a system is illustrated and described, for instance, in document U.S. Pat. No. 3,838,648 (FIG. 12: column 7, lines 22-29). A closing system of this type reduces risk of penetration of water and debris into the duct or even prevents a person to be knocked down in the slot upon crossing the roadway.

Notwithstanding, at the duct bottom, one may foresee openings for water to flow out connected to the rain water network.

In addition, the frontal driving assembly 6, 7 may be provided with an obstacle detector for detecting obstacles of any kind, available on the market, and with a "cowcatcher"-type device to remove or drag debris that may be inside the duct, without causing immediate stoppage of the vehicle.

In addition to means for closing the duct slot when the monorail vehicle is not passing along, it is possible, at least in determined stretches, to provide articulated covers for opening the "roof" of the ducts altogether, for the purpose of maintenance or for removal of the driving assemblies. These covers may be made of a metallic material, for example, in latticework, which do not prevent traffic of vehicles over them when they are closed.

The frontal elevation scissor 4 of the vehicle may be equipped with a covering having a width somewhat larger than the scissor itself. This covering (not shown) may be linked to the rod by means of shock-absorbers for absorbing impact in the event of a collision with a passer-by, a vehicle or other obstacle. The covering may also incorporate a warning light and a sound alert device such as a horn.

The transportation system of the present invention can operate in connection with elevated platforms for embarkation/disembarkation of passengers and/or loading/unloading. However, as already described, the cabin can be lowered to or close to ground level for this operation.

As can be seen in FIG. 1, the vehicle may have front windshields on the upper part and on the lower part, so that the driver of the vehicle can have a good view of the street immediately ahead and below.

Examples of preferred embodiments having been described, it should be understood that the scope of the present invention embraces other possible variations, being limited only by the contents of the accompanying claims, which includes possible equivalents.

For example, although reference is always made to a "monorail" system, it should be understood that this definition embraces the provision of two ducts very close to each other, as shown in FIG. 11c of document U.S. Pat. No. 3,838,648.

Another possible variation within the same concept consists in using a side-rail structure, like that of U.S. Pat. No. 4,690,064, where the rail is kept at ground level, while the support arm is sized to maintain the vehicle elevated with respect to the ground.

A further variation within the same concept consists in that, at least in stretches where it is not relevant whether the rail is totally embedded in the ground, the wheel may run above ground level and the rail may be limited to a Y-shaped metallic structure, located between the main wheels and against whose structure the inclined auxiliary wheels rest, as described in U.S. Pat. No. 5,845,581.

The invention claimed is:

1. A monorail vehicle comprising a cabin for housing a driver, passengers and/or load and comprising at least one driving assembly, the at least one driving assembly adapted for running within a guiding duct on the ground, the cabin being connected to the at least one driving assembly (6, 7) by means of an elongated elevation structure (4), said vehicle further comprising means for actuating the elevation structure (4) to vary and stably maintain a raised elevation of the cabin (2) in a controlled manner with respect to the ground during travel of the vehicle while the vehicle is moving or stopped for embarking/disembarking passengers, wherein the means for actuating the elevation structure selectively vary and selectively maintain elevation of the cabin during travel of the vehicle and also during passenger embarking/disembarking conditions; wherein, the raised elevation is a level that creates a clear vertical space, between the cabin and the driving assembly, to allow the bottom of the cabin and the top of the driving assembly to respectively stay clear of the top and bottom of a vehicle adjacent to the monorail vehicle.

2. A monorail vehicle according to claim 1, wherein the elongated elevation structure comprises two elongated sections that are pivoted with each other so as to define a scissors structure (4) that pivots approximately in its middle portion, wherein the elongated sections are also pivotally connected to the cabin (2) and to the at least one driving assembly (6, 7), where at least one of the elongated sections can slide under the cabin (2).

3. A monorail vehicle according to claim 2, wherein said means for actuating the elevation structure comprise at least one hydraulic piston (9).

4. A monorail vehicle according to claim 2, wherein said means for actuating the elevation structure comprise at least one pneumatic piston (9).

5. A monorail vehicle according to claim 2, wherein:

said cabin comprises one or more cabin sections;

each cabin section is associated with a respective front driving assembly and a respective rear driving assembly;

for each cabin section, one of the two elongated sections of the scissors connects with a front part of said cabin section and with said rear driving assembly, while the other elongated section of the scissor connects with a rear part of the cabin section and with said front driving assembly.

6. A monorail vehicle according to claim 1, wherein each elongated elevation structure (4) has a double structure side-by-side.

7. A monorail vehicle according to claim 1, wherein the at least one driving assembly comprises a motor (6) coupled to a set of wheels (7).

8. A monorail vehicle according to claim 7, wherein the motor (6) is an electric motor.

9. A monorail vehicle according to claim 7, wherein the set of wheels comprises vertical wheels and horizontal or inclined auxiliary wheels.

10. A monorail vehicle according to claim 1, wherein the cabin is supported on the elongated elevation structure (4) by an active suspension device capable of inclining the cabin (2).

11. A monorail vehicle comprising:

a cabin for housing a driver, passengers and/or a load;

a driving assembly running within a guiding duct on the ground;

an elongated elevation linkage interconnecting the cabin to the driving assembly;

actuating means operatively connected to the elongated elevation linkage and selectively actuable for raising and lowering the cabin relative to the driving assembly for controlling and maintaining a raised elevation of the cabin above the driving assembly during travel;

said actuating means being selectively actuable to alter said elevation of said cabin simultaneously with said driving assembly being operative to move within said guiding duct, wherein said actuating means stably controls and maintains elevation of said cabin during travel conditions;

wherein, the raised elevation is a level that creates a clear vertical space, between the cabin and the driving assembly, to allow the bottom of the cabin and the top of the driving assembly to respectively stay clear of the top and bottom of a vehicle adjacent to the monorail vehicle.

* * * * *